US011686156B2

(12) United States Patent
Munguia et al.

(10) Patent No.: US 11,686,156 B2
(45) Date of Patent: Jun. 27, 2023

(54) DRILLING SYSTEM WITH MUD MOTOR INCLUDING MUD LUBRICATED BEARING ASSEMBLY

(71) Applicant: Halliburton Energy Services, Inc., Houston, TX (US)

(72) Inventors: Joseph Munguia, Houston, TX (US); Hasib Uddin, Houston, TX (US); John R Hardin, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 90 days.

(21) Appl. No.: 17/457,084

(22) Filed: Dec. 1, 2021

(65) Prior Publication Data

US 2023/0167685 A1 Jun. 1, 2023

(51) Int. Cl.
*E21B 4/00* (2006.01)
*E21B 7/06* (2006.01)
*E21B 4/02* (2006.01)

(52) U.S. Cl.
CPC ..... *E21B 4/003* (2013.01); *E21B 4/02* (2013.01); *E21B 7/06* (2013.01)

(58) Field of Classification Search
CPC ..... E21B 4/003; E21B 7/06
See application file for complete search history.

(56) References Cited

U.S. PATENT DOCUMENTS 8,827,562 B2 9/2014 Marchand et al.
9,006,155 B2 4/2015 Roddy et al.
9,051,505 B2 6/2015 Roddy et al.
10,844,662 B2 11/2020 Von Gynz-rekowski et al.
2006/0131033 A1 6/2006 Bode et al.
2009/0196541 A1 8/2009 Johnson
2019/0330925 A1* 10/2019 Marchand ..... E21B 21/08
2020/0141188 A1 5/2020 Marshall et al.

FOREIGN PATENT DOCUMENTS

CN 113079701 A 7/2021
WO 2013170117 A1 11/2013
WO 2020096780 A1 5/2020

OTHER PUBLICATIONS

International Search Report and the Written Opinion dated Aug. 19, 2022 for corresponding PCT Patent Application No. PCT/US2021/061381 filed on Dec. 1, 2021.

* cited by examiner

*Primary Examiner* — Giovanna Wright
(74) *Attorney, Agent, or Firm* — K&L Gates LLP

(57) ABSTRACT

A drilling system for drilling a wellbore using drilling fluid includes a drillstring, a drill bit coupled to the drillstring, and a mud motor coupled to the drillstring and operable to rotate the drill bit by rotating a driveshaft with a bore. The drilling system also includes a bearing assembly that includes a bypass fluid flowpath through the bearings for drilling fluid to divert from the bore. A choke assembly positioned in the bypass fluid flowpath restricts flow of the diverted drilling fluid such that some diverted drilling fluid flows into an annulus in the wellbore outside of the bearing assembly through an unsealed annulus port and some of diverted drilling fluid is recaptured through a return flowline. The drilling system also includes a rotary steerable system operable to push the drill bit in a desired direction using pads extendable with the drilling fluid.

20 Claims, 6 Drawing Sheets

DRILLING SYSTEM WITH MUD MOTOR INCLUDING MUD LUBRICATED BEARING ASSEMBLY

BACKGROUND

Directional drilling involves drilling a wellbore that deviates from a vertical path, such as drilling horizontally through a subterranean formation. Rotary steerable systems are employed to control the direction of a drill bit while drilling. In a point-the-bit rotary steerable system, an internal shaft within the system is deflected to direct the drill bit. In a push-the-bit rotary steerable system, a pad pushes against the subterranean formation to direct the bit.

A push-the-bit rotary steerable system (RSS) includes a motor with a bearing section. The bearing section may be sealed and lubricated by internal oil, or unsealed and lubricated by drilling fluid flowing through the mud motor to the drill bit. For an unsealed bearing section, loss of drilling fluid to the annulus is inevitable due to bearing tolerances, manufacturing constraints, and erosive wear from the flowing mud. The fluid flow to annulus can be used to lubricate the bearing section, but the flow must be controlled to provide pad force to steer the drill bit while avoiding excess erosion. A need exists, therefore, for a means of controlling the bypass flow of drilling fluid to the annulus.

BRIEF DESCRIPTION OF THE DRAWINGS

Embodiments of the drilling system with mud motor including mud lubricated bearing assembly are described with reference to the following figures. The same or sequentially similar numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
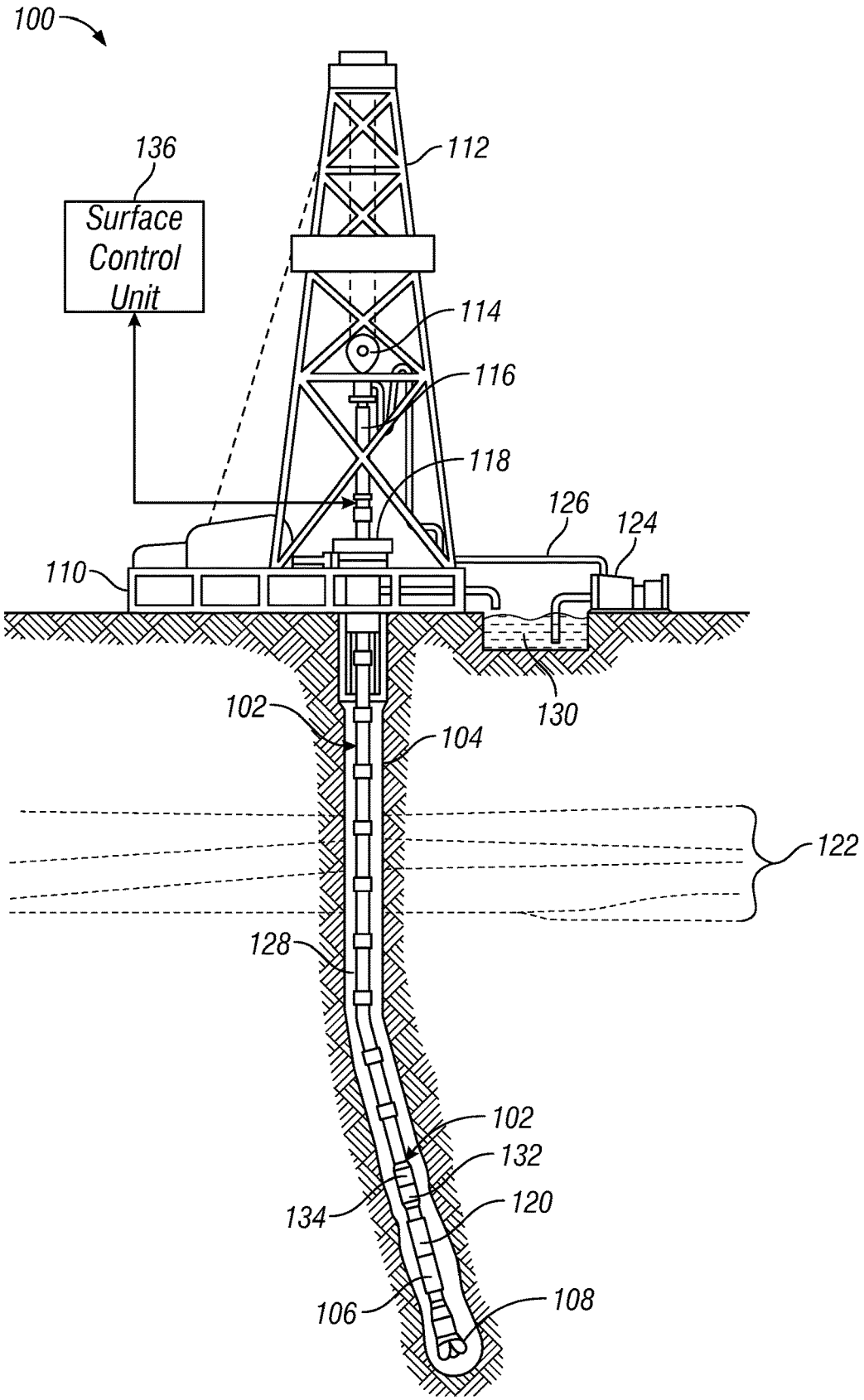
FIG. 1 is a schematic view of a drilling system, according to one or more embodiments.

A subterranean formation containing oil or gas hydrocarbons may be referred to as a reservoir, in which a reservoir may be located on-shore or offshore. Reservoirs are typically located in the range of a few hundred feet (shallow reservoirs) to tens of thousands of feet (ultra-deep reservoirs). To produce oil, gas, or other fluids from the reservoir, a well is drilled into a reservoir or adjacent to a reservoir.

A well can include, without limitation, an oil, gas, or water production well, or an injection well. As used herein, a "well" includes at least one wellbore having a wellbore wall. A wellbore can include vertical, inclined, and horizontal portions, and it can be straight, curved, or branched. As used herein, the term "wellbore" includes any cased, and any uncased, open-hole portion of the wellbore. Further, the term "uphole" refers a direction that is towards the surface of the well, while the term "downhole" refers a direction that is away from the surface of the well.

The present disclosure provides a drilling system for drilling a wellbore that includes a push-the-bit rotary steerable system (RSS), a mud motor, and a mud motor bearing assembly. The bearing assembly includes radial bearings, thrust bearings, and/or ball bearings or roller bearings that support a driveshaft that extends between the mud motor and a drill bit. The bearing assembly also includes a bypass fluid flowpath through the bearings and into an annulus surrounding the bearing assembly that allows drilling fluid to be diverted and bypass a central bore of the driveshaft and flow instead through the bearings, lubricating and cooling the bearings. The bearing assembly also includes a choke assembly that restricts but does not prevent the flow of the diverted drilling fluid into the annulus and recaptures at least some of the diverted drilling fluid back into the driveshaft. The diverted drilling fluid that is recaptured provides pressure to operate the RSS and therefore the bearing assembly does not need to be sealed for recapturing all of the diverted drilling fluid from the bearing assembly.

Although the bearing assembly may be used with many types of drilling systems having a mud motor, the bearing assembly is particularly applicable to a motor-assisted rotary steerable system ("MARSS"). A MARSS utilizes drilling fluid that passes through the mud motor and the bearing assembly to extend pads to push the drill bit in a desired direction. The bearing assembly is operable to recapture at least some of the drilling fluid flowing through the bearing assembly at a pressure sufficient to power the pads of the RSS without the need to seal the diverted drilling fluid from flowing out into the annulus.

In operation, drilling fluid is pumped down the bore of the drillstring to power the mud motor. The drilling fluid then enters a bearing assembly where some of the drilling fluid is diverted from a central bore into a bypass fluid flowpath to cool and lubricate bearings. Some of the diverted drilling fluid flows through the bypass fluid flowpath, through a choke assembly and out into the annulus through an unsealed annulus bore. Some of the drilling fluid is recaptured however and directed back into the drillstring to operate the RSS pads. The RSS is then operated with the drilling fluid in the drillstring to steer the drill bit and drill the wellbore.

FIG. 1 is a schematic view of a drilling system 100, according to one or more embodiments. The drilling system 100 is used to direct a drill bit in drilling a wellbore, such as a subsea well or a land well. The wellbore is not limited to only an oil well. The present disclosure also encompasses natural gas wellbores, other hydrocarbon wellbores, or wellbores in general. Further, the present disclosure may be used for the exploration and formation of geothermal wellbores intended to provide a source of heat energy instead of hydrocarbons.

FIG. 1 shows a drillstring 102 disposed in a directional wellbore 104. The drillstring 102 includes a push-the-bit rotary steerable system ("RSS") 106 that provides full 3D directional control of the drill bit 108. A drilling platform 110 supports a derrick 112 having a traveling block 114 for raising and lowering a drillstring 102. A kelly 116 supports the drillstring 102 as the drillstring 102 is lowered through a rotary table 118. Alternatively, a top drive can be used to rotate the drillstring 102 in place of the kelly 116 and the rotary table 118. A drill bit 108 is positioned at the downhole end of the drillstring 102 and is driven at least in part by a downhole motor 120 positioned on the drillstring 102. As the bit 108 rotates, the bit 108 forms the wellbore 104 that passes through various formations 122. A pump 124 circulates drilling fluid through a feed pipe 126 and downhole through the interior of drillstring 102, through orifices in drill bit 108, back to the surface via the annulus 128 around drillstring 102, and into a retention pit 130. The drilling fluid transports cuttings from the wellbore 104 into the pit 130 and aids in maintaining the integrity of the wellbore 104. The drilling fluid also drives the downhole motor 120, as discussed in more detail below.

The drillstring 102 may include one or more logging while drilling (LWD) or measurement-while-drilling (MWD) tools 132 that collect measurements relating to various wellbore and formation properties as well as the position of the bit 108 and various other drilling conditions as the bit 108 extends the wellbore 104 through the formations 122. The LWD/MWD tool 132 may include a device for measuring formation resistivity, a gamma ray device for measuring formation gamma ray intensity, devices for measuring the inclination and azimuth of the drillstring 102, pressure sensors for measuring drilling fluid pressure, temperature sensors for measuring wellbore temperature, etc.

The drillstring 102 may also include a telemetry module 134. The telemetry module 134 receives data provided by the various sensors of the drillstring 102 (e.g., sensors of the LWD/MWD tool 132), and transmits the data to a surface unit 136. Data may also be provided by the surface unit 136, received by the telemetry module 134, and transmitted to the tools (e.g., LWD/MWD tool 132, rotary steering tool 106, etc.) of the drillstring 102. Mud pulse telemetry, wired drill pipe, acoustic telemetry, or other telemetry technologies known in the art may be used to provide communication between the surface control unit 136 and the telemetry module 134. The surface unit 136 may also communicate directly with the LWD/MWD tool 132 and/or the rotary steering tool 106. The surface unit 136 may be a computer stationed at the well site, a portable electronic device, a remote computer, or distributed between multiple locations and devices. The unit 136 may also be a control unit that controls functions of the equipment of the drillstring 102.

Figure 2:
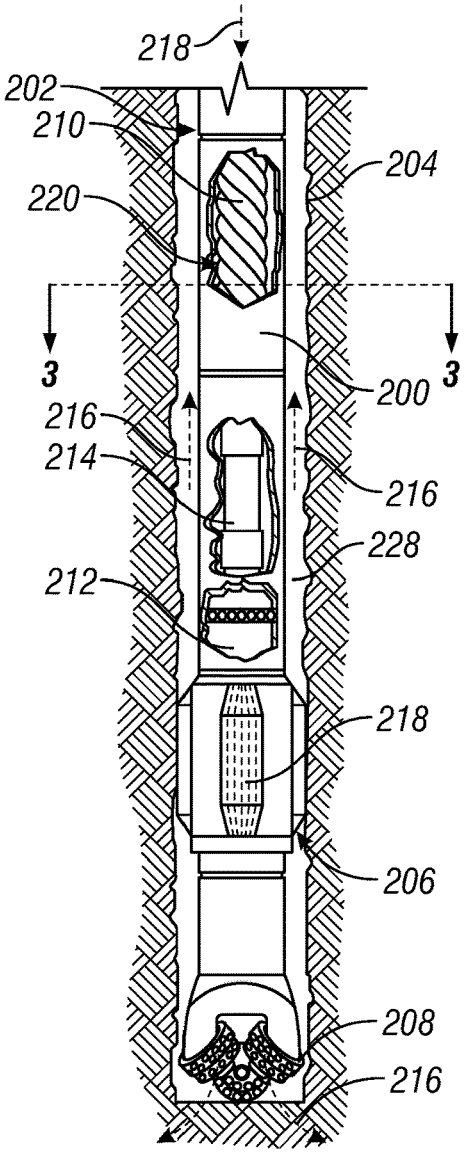
FIG. 2 is a broken side view of a portion of a drillstring disposed in a borehole, according to one or more embodiments.
Figure 3:
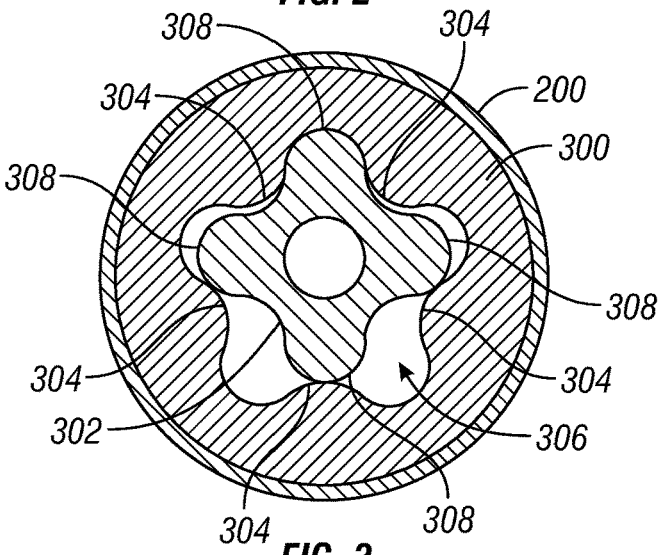
FIG. 3 is a cross-section view of the stator and rotor of the drillstring of FIG. 2.

FIGS. 2 and 3 are a broken side view and a cross section view of a drillstring 202 disposed in a wellbore 204 and that includes a downhole motor 220 connected to a drill bit 208. The downhole motor 220 includes a tubular housing 200 that encloses a power unit 210. The power unit 210 is connected to a bearing assembly 212 via a transmission unit 214. The bearing assembly 212 supports a driveshaft (not shown) extending between the downhole motor 220 and the drill bit 208 to rotate the drill bit 208. Referring to FIG. 3, the power unit 210 includes a stator 300 and a rotor 302. The stator 300 includes multiple (e.g., five) lobes 304 extending along the stator 300 in a helical configuration and defining a cavity 306. The rotor 302 also includes lobes 308 extending along the rotor 302 in a helical configuration. The stator 300 and rotor 302 can also have more or fewer lobes where the difference between the rotor lobes 308 and stator lobes 304 is one extra stator lobe 304 for the number of rotor lobes 308.

The rotor 302 is operatively positioned in the cavity 306 such that the rotor lobes cooperate with the stator lobes 304 in that applying fluid pressure to the cavity 306 by flowing fluid within the cavity 306 causes the rotor 302 to rotate within the stator 300. For example, referring to FIGS. 2 and 3, pressurized drilling fluid (e.g., drilling mud) 216 can be introduced at an upper end of the power unit 210 and forced down through the cavity 306. The pressurized drilling fluid entering cavity 306, in cooperation with the lobes 304 of the stator 300 and the geometry of the stator 300 and the rotor 302, causes the rotor 302 to turn to allow the drilling fluid 216 to pass through the motor 220 and thus rotates the rotor 302 relative to the stator 300. The drilling fluid 216 subsequently exits through ports (e.g., jets) in the drill bit 208, travels upward through an annulus 228 between the drillstring 202 and the wellbore 204, and is received at the surface where it is captured and pumped down the drillstring 202 again.

As shown in FIG. 2, a push-the-bit RSS 206 is positioned on the drillstring 202 downhole of the downhole motor 220. The drilling fluid 216 passes through the downhole motor 220 and then a portion of the drilling fluid 216 is diverted to flow through the bearing assembly 212, bypassing a central bore through the bearing assembly 212, as described in more detail below. The non-diverted drilling fluid passes through the central bore of the bearing assembly. The diverted drilling fluid 216 passes through the bearings and at least some of the diverted drilling fluid flows into the annulus 228. At least some of the diverted drilling fluid is recaptured though and may be used to provide the hydraulic pressure necessary to extend pads (one indicated, 218) of the RSS 206 to direct the drill bit 208. To provide sufficient pressure to extend the pads 218 of the RSS 206, the amount of drilling fluid 216 diverted through the bearings is controlled to maintain the amount of hydraulic pressure available to extend the pads 218 above an appropriate amount.

Figure 4A:
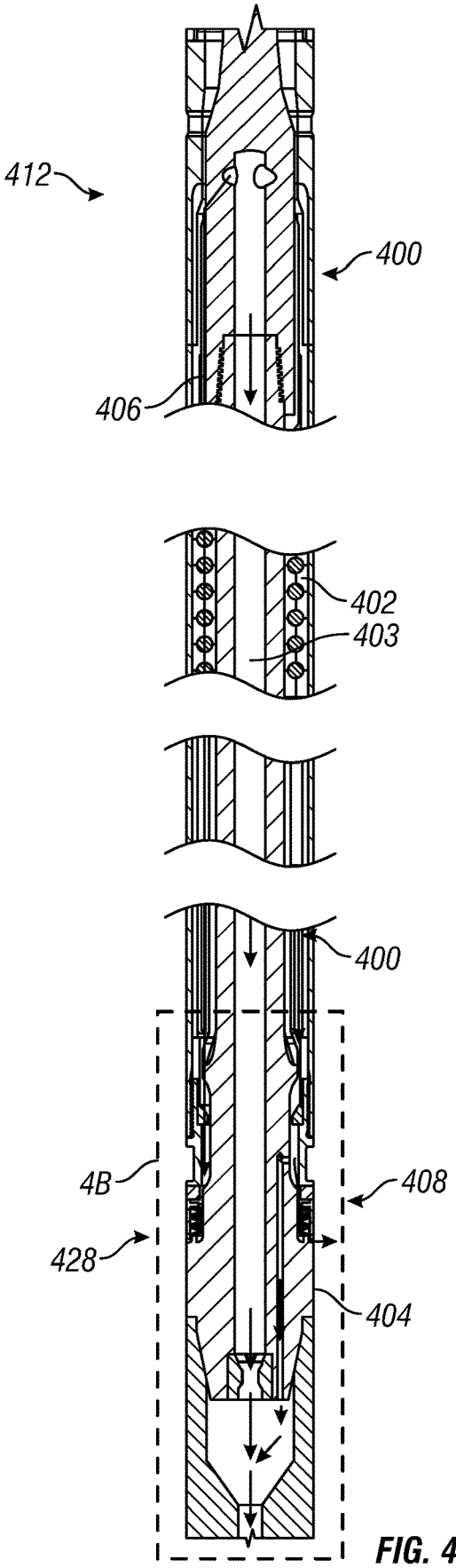
FIGS. 4A and 4B are cross section views of a bearing assembly, according to one or more embodiments.
Figure 4B:
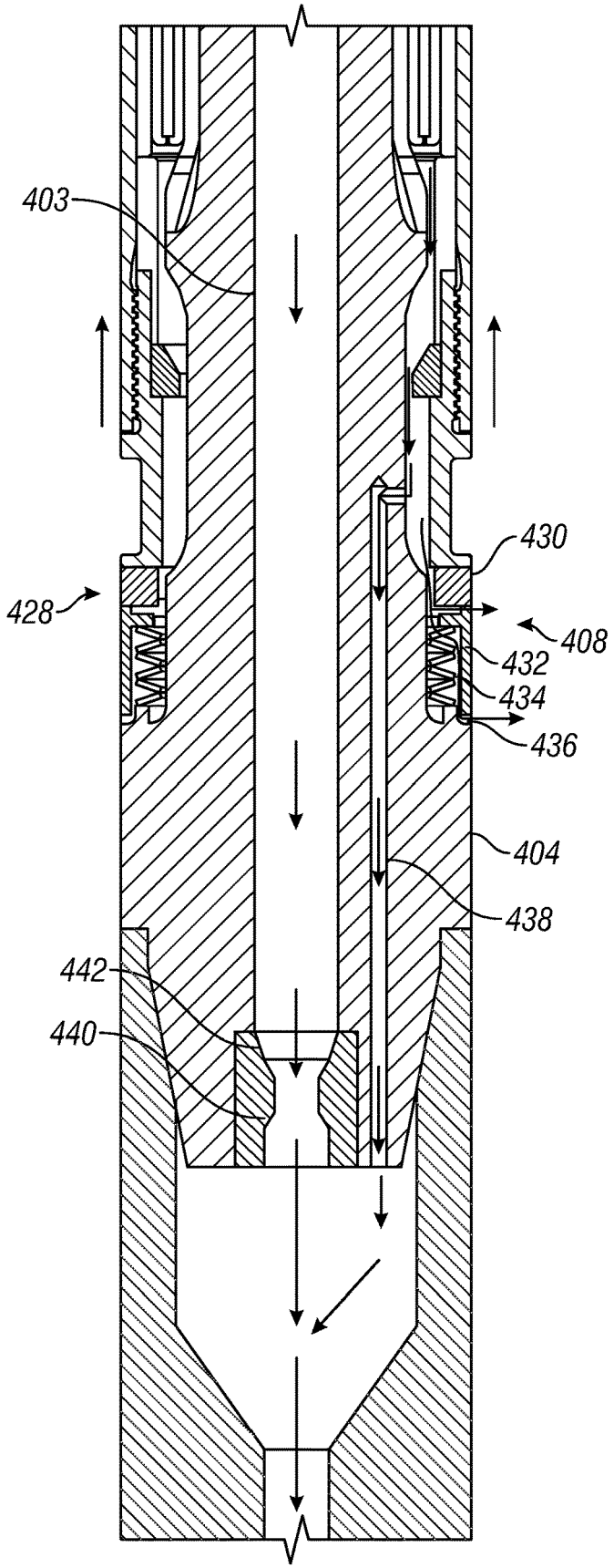

Turning now to FIGS. 4A and 4B, FIGS. 4A and 4B illustrate a bearing assembly 412 used in a drillstring, such as the drillstring 202, according to one or more embodiments. The bearing assembly 412 includes radial bearing assemblies 400 and ball bearings 402 or roller bearings (not shown) that are positioned circumferentially around a driveshaft 404 that extends between a downhole motor (not shown) and a drill bit (not shown) to support the driveshaft 404. The bearing assembly 412 may also include a PDC thrust bearing (not shown).

A bypass fluid flowpath 406 extends from an entrance from the central bore 403 of the driveshaft 404, through the bearings 400, 402, through a choke assembly 408, and through an annulus port or ports 436 out into the wellbore annulus 428 surrounding the bearing assembly 412. As discussed above, a portion of drilling fluid passing through the driveshaft 404 is diverted through the bypass fluid flowpath 406 to cool and lubricate the bearings 400, 402. The choke assembly 408 is disposed within the bypass fluid flowpath 406 and controls the amount of drilling fluid that passes through the bypass fluid flowpath 406 from the central bore 403 by restricting fluid flow out of the bypass fluid flowpath 406 to create a pressure drop. Additionally, since the bypass fluid flowpath 406 is not sealed to the annulus 428, the choke assembly 408 controls the amount of diverted drilling fluid that either flows into an annulus 428 or that is recaptured into the bearing assembly 412 for powering the extension of the pads of the RSS. By controlling the amount of drilling fluid passing into the annulus 428, sufficient hydraulic pressure is maintained in the drilling fluid flowing through the driveshaft 404 as well as the diverted drilling fluid being recaptured to extend the pads of the RSS.

Turning now to FIG. 4B, FIG. 4B is a close up view of the choke assembly 408 positioned within the bypass fluid flowpath 406 of the bearing assembly 412 of FIG. 4A. The choke assembly 408 includes a choke 430 that contacts a seat 432 to restrict the amount of drilling fluid passing through the bypass fluid flowpath 406 out the annulus port or ports 436 in the choke 430, the seat 432, or between the choke 430 and the seat 432 to the annulus 428. A biasing mechanism 434, such as a spring, exerts a biasing force on the choke 430 in an uphole direction based on the expected pressure of the drilling fluid and the pressure within the borehole annulus 428. In other embodiments, the seat 432 may be uphole of the choke 430 and the biasing mechanism 434 may exert a biasing force on the choke in a downhole direction based on the expected pressure of the drilling fluid and the pressure within the borehole annulus 428. To control the amount of drilling fluid that is diverted from the central bore 403 and that flows into the annulus 428, the biasing force shifts the seat 432 into contact with the choke 430 such that the choke assembly 408 only allows so much diverted drilling fluid to flow into the annulus 428. Doing so maintains hydraulic pressure available for extending the pads of the RSS. For example, the choke assembly 408 may only allow a range between approximately 1% and approximately 7% of the drilling fluid passing through the driveshaft 404 to be diverted into the fluid flowpath 406. Additionally, the choke 430 and/or the seat 432 may include channels (not shown) extending radially through the choke 430 and/or the seat 432 to ensure that between approximately 1% and approximately 7% of the drilling fluid can pass through the choke assembly 408 when the choke 430 contacts the seat. However, other choke assemblies 408 may allow less than 1% or more than 7% of the drilling fluid to pass through the bypass fluid flowpath 406 as appropriate.

Diverted drilling fluid that does not flow through the annulus port 436 and out into the annulus 428 is recaptured through a return flowline 438 in communication with the bypass fluid flowpath 406 upstream of the choke assembly 408. At least some of the diverted drilling fluid flows through the choke assembly 408 and out into the annulus while at least some of the diverted drilling fluid is also recaptured into the bearing assembly 412 through the return flowline 438. To assist with recapturing diverted drilling fluid, the return flowline 438 may include a nozzle or orifice shaped to lower the flow resistance into the return flowline 438. The nozzle or orifice may also be made of a carbide material for wear resistance from the recaptured drilling fluid. The recaptured drilling fluid in the return flowline 438 may then be communicated further downstream of the bearing assembly 412 and communicated back into the central bore of the drillstring below the bearing assembly 412 for extending the RSS pads. However, before rejoining the recaptured drilling fluid, the drilling fluid flowing through the central bore 403 flows through a restriction collar or sleeve 440 that includes a restriction 442. The restriction 442 creates a pressure drop below the pressure in the return flowline 438, allowing the recaptured drilling fluid in the return flowline 438 to rejoin the drilling fluid in the central bore of the drillstring below the bearing assembly 412.

Figure 5A:
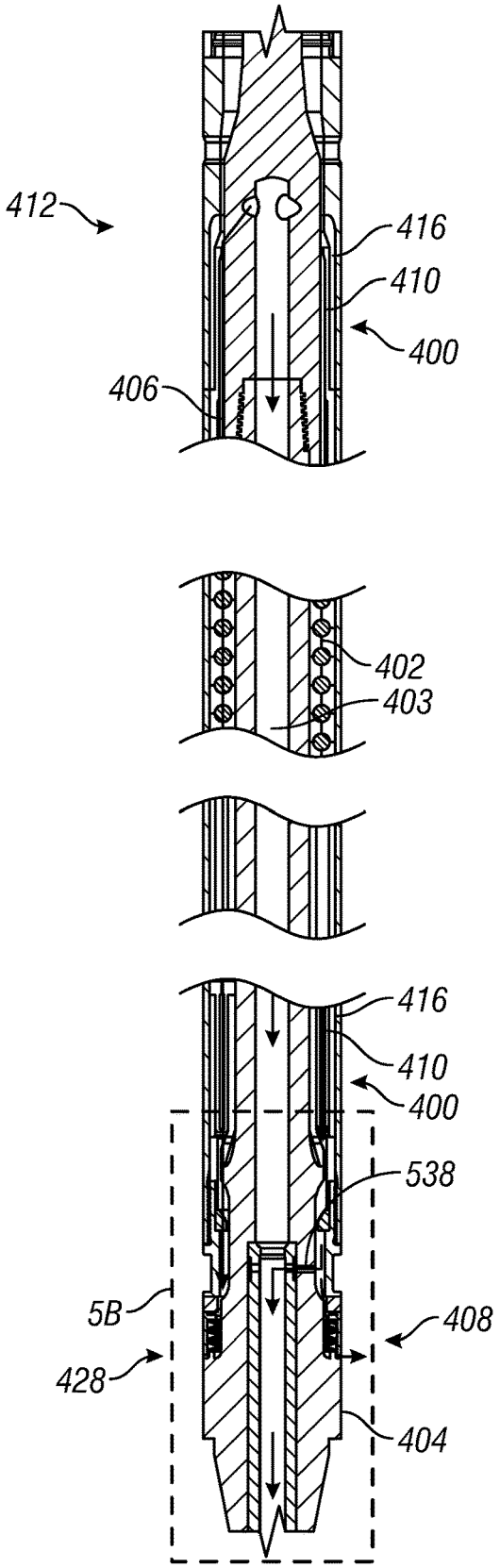
FIGS. 5A and 5B are cross section views of another bearing assembly, according to one or more embodiments.
Figure 5B:
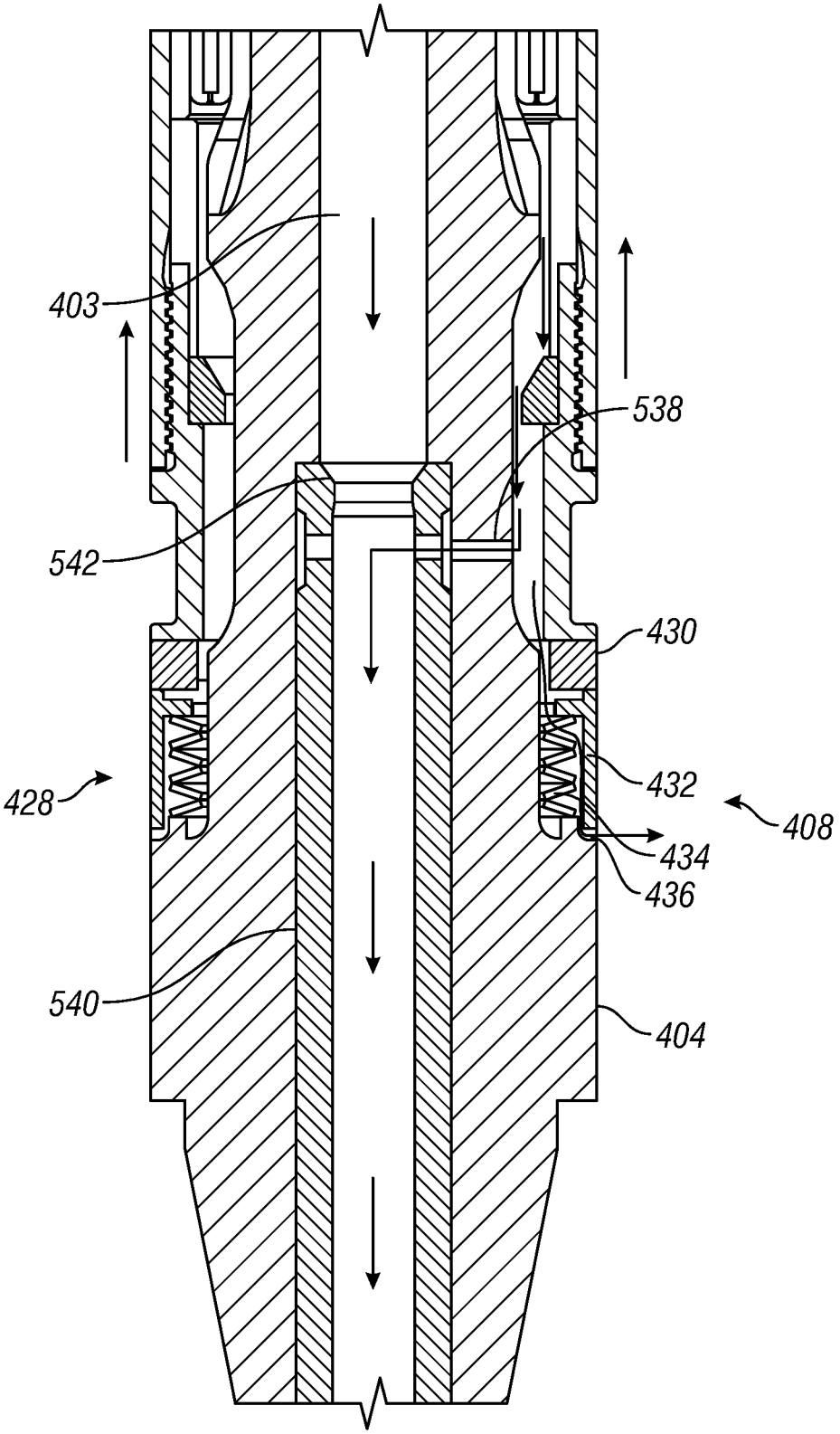

Turning now to FIGS. 5A and 5B, FIGS. 5A and 5B illustrate an alternative bearing assembly 412 used in a drillstring, such as the drillstring 202, according to one or more embodiments. The bearing assembly 412 in FIGS. 5A and 5B is similar to the bearing assembly 412 discussed with respected to FIGS. 4A and 4B except as discussed below and therefore similar components and operation will not be repeated.

The choke assembly 408 is disposed within the bypass fluid flowpath 406 and controls the amount of drilling fluid that passes through the bypass fluid flowpath 406 from the central bore 403 by restricting fluid flow out of the bypass fluid flowpath 406 to create a pressure drop. Additionally, since the bypass fluid flowpath 406 is not sealed to the annulus 428, the choke assembly 408 controls the amount of diverted drilling fluid that either flows into an annulus 428 or that is recaptured into the bearing assembly 412 for powering the extension of the pads of the RSS. By controlling the amount of drilling fluid passing into the annulus 428, sufficient hydraulic pressure is maintained in the drilling fluid flowing through the driveshaft 404 as well as the diverted drilling fluid being recaptured into the bearing assembly 412 to extend the pads of the RSS. However, instead of the return flowline directly recapturing drilling fluid through the end of the bearing assembly 412, the bearing assembly 412 in FIGS. 5A and 5B include a return flowline 538 that directs the recaptured drilling fluid back into the central bore 403 within the bearing assembly 412. At least some of the diverted drilling fluid flows through the choke assembly 408 and out into the annulus while at least some of the diverted drilling fluid is also recaptured into the bearing assembly 412 through the return flowline 538. The recaptured drilling fluid in the return flowline 538 may then be communicated further downstream of the bearing assembly 412 to the RSS for extending the RSS pads. However, as discussed above, the recaptured drilling fluid rejoins the central bore 403 downstream of a restriction that creates a pressure drop. Therefore, as shown in FIGS. 5A and 5B, a restriction sleeve 540 extends further into the bearing assembly 412 such that the restriction 542 that creates the pressure drop is upstream of the return flowline 538 and thus before the recaptured drilling fluid rejoins the central bore 403. The fluid exit of return flowline 538 can be placed just downstream of restriction 542 such that the return of the recaptured drilling fluid is at a local low pressure zone just downstream of restriction 542 before partial recovery of pressure in the central bore 403 further downstream of the restriction 542.

Examples of the above embodiments include:

Example 1. A drilling system for drilling a wellbore using drilling fluid, the drilling system comprising: a drillstring comprising a mud motor, a bearing assembly, and a rotary steerable system (RSS); and a drill bit coupled to the drillstring. The mud motor is coupled to the drillstring uphole of the drill bit and is operable to rotate the drill bit. The bearing assembly comprises: a driveshaft including a bore and rotatable by the mud motor; bearings positioned circumferentially around the driveshaft and operable to rotationally support rotation of the driveshaft; a bypass fluid flowpath through the bearings open for drilling fluid to divert from the bore and flow through the bearings; and a choke assembly positioned in the bypass fluid flowpath and operable to restrict flow of the diverted drilling fluid through the bypass fluid flowpath such that at least some of the diverted drilling fluid flows through an unsealed annulus port into an annulus in the wellbore outside of the bearing assembly and at least some of the diverted drilling fluid is recaptured from the bypass fluid flowpath through a return flowline in fluid communication with the drillstring. The RS S is operable to push the drill bit in a desired direction using pads extendable using the drilling fluid flowing through the bore and the recaptured diverted drilling fluid.

Example 2. The system of Example 1, wherein the return flowline is in fluid communication with the drillstring downstream of the bearing assembly.

Example 3. The system of Example 1, wherein the return flowline is in fluid communication with the drillstring in the bearing assembly.

Example 4 The system of Example 1, wherein the choke assembly is biased to control the flow of diverted drilling fluid through the annulus bore based on a pressure of the diverted drilling fluid in the bypass fluid flowpath.

Example 5. The system of Example 1, wherein the bearings comprise a radial bearing assembly shaped to restrict the flow of the drilling fluid through the bypass fluid flowpath.

Example 6. The system of Example 1, wherein the choke assembly allows a range between approximately 1% and approximately 7% of the drilling fluid flowing through the drillstring to be diverted into the bypass fluid flowpath.

Example 7. The system of Example 1, wherein the driveshaft further includes a restriction in the bore downstream of an entrance of the bypass fluid flowpath and upstream of where the return flowline is in communication with the drillstring.

Example 8. The system of Example 7, wherein the return flowline is in communication with the drillstring at a local low pressure zone in the bore just downstream of the restriction.

Example 9. A method of drilling a wellbore, the method comprising: pumping drilling fluid down a drillstring within the wellbore to operate a drill bit, the drillstring including a mud motor, a bearing assembly, and a rotary steerable system (RSS); rotating a driveshaft comprising a bore of the bearing assembly with the mud motor to rotate the drill bit and drill the wellbore; supporting the rotation of the driveshaft with the bearing assembly; diverting a portion of the drilling fluid from the bore of the driveshaft through a bypass fluid flowpath through bearings of the bearing assembly; restricting flow of the drilling fluid into the bypass fluid flowpath using a choke assembly in the bypass fluid flowpath; flowing at least some of the diverted drilling fluid past the choke assembly and into an annulus in the wellbore outside of the bearing assembly through an unsealed annulus port; recapturing at least some of the diverted drilling fluid into the bore from the bypass fluid flowpath through a return flowline; and extending pads of the RSS using the drilling fluid in the bore to push a drill bit to drill the wellbore in a desired direction using the drilling fluid flowing through the bore.

Example 10. The method of Example 9, wherein recapturing at least some of the diverted drilling fluid further comprises flowing at least some of the diverted drilling fluid through the return flowline into the bore at a location downstream of the choke assembly.

Example 11. The method of Example 9, wherein recapturing at least some of the diverted drilling fluid further comprises flowing at least some of the diverted drilling fluid through the return flowline into the bore at a location upstream of the choke assembly.

Example 12. The method Example 9, further comprising biasing the choke assembly to control the flow of diverted drilling fluid through the annulus bore based on a pressure of the diverted drilling fluid in the bypass fluid flowpath.

Example 13. The method of Example 9, wherein the choke assembly allows a range between approximately 1% and approximately 7% of the drilling fluid flowing through the drillstring to be diverted into the bypass fluid flowpath.

Example 14. The method of Example 9, further comprising restricting flow of drilling fluid in the bore to create a pressure drop downstream of an entrance of the bypass fluid flowpath and upstream of the return flowline joining the bore such that the pressure of the drilling fluid in the bore is less than the recaptured drilling fluid in the return flowline.

Example 15. The method of Example 14, wherein the return flowline joins the bore at a local low pressure zone just downstream of the restricting flow of drilling fluid in the bore.

Example 16. A bearing assembly for operation with a drillstring including a mud motor and a rotary steerable system (RSS) powered by drilling fluid, the bearing assembly comprising: a driveshaft including a bore and rotatable by the mud motor; bearings positioned circumferentially around the driveshaft and operable to rotationally support rotation of the driveshaft; a bypass fluid flowpath open for drilling fluid to divert from the bore of the driveshaft and flow through the bearings; and a choke assembly positioned in the bypass fluid flowpath and operable to restrict flow of the diverted drilling fluid through the bypass fluid flowpath such that at least some of the diverted drilling fluid flows through an unsealed annulus port into an annulus in a wellbore outside of the bearing assembly and at least some of the diverted drilling fluid is recaptured from the bypass fluid flowpath through a return flowline in fluid communication with the drillstring.

Example 17. The assembly of Example 16, wherein the return flowline is in fluid communication with the drillstring downstream of the bearing assembly.

Example 18. The assembly of Example 16, wherein the return flowline is in fluid communication with the drillstring in the bearing assembly.

Example 19. The assembly of Example 16, wherein the choke assembly is biased to control the flow of diverted drilling fluid through the annulus bore based on a pressure of the diverted drilling fluid in the bypass fluid flowpath.

Example 20. The assembly of Example 16, wherein the driveshaft further includes a restriction in the bore downstream of an entrance of the bypass fluid flowpath and upstream of where the return flowline is in communication with the drillstring.

Certain terms are used throughout the description and claims to refer to particular features or components. As one skilled in the art will appreciate, different persons may refer to the same feature or component by different names. This document does not intend to distinguish between components or features that differ in name but not function.

While compositions and methods are described herein in terms of "comprising" various components or steps, the compositions and methods can also "consist essentially of" or "consist of" the various components and steps.

Unless otherwise indicated, all numbers expressing quantities are to be understood as being modified in all instances by the term "about" or "approximately". Accordingly, unless indicated to the contrary, the numerical parameters are approximations that may vary depending upon the desired properties of the present disclosure.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A drilling system for drilling a wellbore using drilling fluid, the drilling system comprising:

a drillstring comprising a mud motor, a bearing assembly, and a rotary steerable system (RSS); and a drill bit coupled to the drillstring;

wherein the mud motor is coupled to the drillstring uphole of the drill bit and is operable to rotate the drill bit;

wherein the bearing assembly comprises:

a driveshaft including a bore and rotatable by the mud motor;

bearings positioned circumferentially around the driveshaft and operable to rotationally support rotation of the driveshaft;

a bypass fluid flowpath through the bearings open for drilling fluid to divert from the bore and flow through the bearings; and a choke assembly positioned in the bypass fluid flowpath and operable to restrict flow of the diverted drilling fluid through the bypass fluid flowpath such that at least some of the diverted drilling fluid flows through an unsealed annulus port into an annulus in the wellbore outside of the bearing assembly and at least some of the diverted drilling fluid is recaptured from the bypass fluid flowpath through a return flowline in fluid communication with the drillstring; and wherein the RSS is operable to push the drill bit in a desired direction using pads extendable using the drilling fluid flowing through the bore and the recaptured diverted drilling fluid.

2. The system of claim 1, wherein the return flowline is in fluid communication with the drillstring downstream of the bearing assembly.

3. The system of claim 1, wherein the return flowline is in fluid communication with the drillstring in the bearing assembly.

4. The system of claim 1, wherein the choke assembly is biased to control the flow of diverted drilling fluid through the annulus bore based on a pressure of the diverted drilling fluid in the bypass fluid flowpath.

5. The system of claim 1, wherein the bearings comprise a radial bearing assembly shaped to restrict the flow of the drilling fluid through the bypass fluid flowpath.

6. The system of claim 1, wherein the choke assembly allows a range between approximately 1% and approximately 7% of the drilling fluid flowing through the drillstring to be diverted into the bypass fluid flowpath.

7. The system of claim 1, wherein the driveshaft further includes a restriction in the bore downstream of an entrance of the bypass fluid flowpath and upstream of where the return flowline is in communication with the drillstring.

8. The system of claim 7, wherein the return flowline is in communication with the drillstring at a local low pressure zone in the bore just downstream of the restriction.

9. A method of drilling a wellbore, the method comprising:

pumping drilling fluid down a drillstring within the wellbore to operate a drill bit, the drillstring including a mud motor, a bearing assembly, and a rotary steerable system (RSS);

rotating a driveshaft comprising a bore of the bearing assembly with the mud motor to rotate the drill bit and drill the wellbore;

supporting the rotation of the driveshaft with the bearing assembly;

diverting a portion of the drilling fluid from the bore of the driveshaft through a bypass fluid flowpath through bearings of the bearing assembly;

restricting flow of the drilling fluid into the bypass fluid flowpath using a choke assembly in the bypass fluid flowpath;

flowing at least some of the diverted drilling fluid past the choke assembly and into an annulus in the wellbore outside of the bearing assembly through an unsealed annulus port;

recapturing at least some of the diverted drilling fluid into the bore from the bypass fluid flowpath through a return flowline; and extending pads of the RSS using the drilling fluid in the bore to push a drill bit to drill the wellbore in a desired direction using the drilling fluid flowing through the bore.

10. The method of claim 9, wherein recapturing at least some of the diverted drilling fluid further comprises flowing at least some of the diverted drilling fluid through the return flowline into the bore at a location downstream of the choke assembly.

11. The method of claim 9, wherein recapturing at least some of the diverted drilling fluid further comprises flowing at least some of the diverted drilling fluid through the return flowline into the bore at a location upstream of the choke assembly.

12. The method claim 9, further comprising biasing the choke assembly to control the flow of diverted drilling fluid through the annulus bore based on a pressure of the diverted drilling fluid in the bypass fluid flowpath.

13. The method of claim 9, wherein the choke assembly allows a range between approximately 1% and approximately 7% of the drilling fluid flowing through the drillstring to be diverted into the bypass fluid flowpath.

14. The method of claim 9, further comprising restricting flow of drilling fluid in the bore to create a pressure drop downstream of an entrance of the bypass fluid flowpath and upstream of the return flowline joining the bore such that the pressure of the drilling fluid in the bore is less than the recaptured drilling fluid in the return flowline.

15. The method of claim 14, wherein the return flowline joins the bore at a local low pressure zone just downstream of the restricting flow of drilling fluid in the bore.

16. A bearing assembly for operation with a drillstring including a mud motor and a rotary steerable system (RSS) powered by drilling fluid, the bearing assembly comprising:

a driveshaft including a bore and rotatable by the mud motor;

bearings positioned circumferentially around the driveshaft and operable to rotationally support rotation of the driveshaft;

a bypass fluid flowpath open for drilling fluid to divert from the bore of the driveshaft and flow through the bearings; and a choke assembly positioned in the bypass fluid flowpath and operable to restrict flow of the diverted drilling fluid through the bypass fluid flowpath such that at least some of the diverted drilling fluid flows through an unsealed annulus port into an annulus in a wellbore outside of the bearing assembly and at least some of the diverted drilling fluid is recaptured from the bypass fluid flowpath through a return flowline in fluid communication with the drillstring.

17. The assembly of claim 16, wherein the return flowline is in fluid communication with the drillstring downstream of the bearing assembly.

18. The assembly of claim 16, wherein the return flowline is in fluid communication with the drillstring in the bearing assembly.

19. The assembly of claim 16, wherein the choke assembly is biased to control the flow of diverted drilling fluid through the annulus bore based on a pressure of the diverted drilling fluid in the bypass fluid flowpath.

20. The assembly of claim 16, wherein the driveshaft further includes a restriction in the bore downstream of an entrance of the bypass fluid flowpath and upstream of where the return flowline is in communication with the drillstring.

* * * * *